US006160465A

United States Patent [19]

Yamaguchi et al.

[11] Patent Number: 6,160,465

[45] **Date of Patent: *Dec. 12, 2000**

[54] HIGH-FREQUENCY CHOKE COIL

[75] Inventors: Kouichi Yamaguchi; Tatsuyuki Yamada, both of Fukui-ken; Yukio Sakamoto, Moriyama; Masami Sugitani, Fukui-ken; Satoshi Murata, Yokaichi, all of Japan

[73] Assignee: Murata Manufacturing Co. Ltd., Kyoto, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/187,278

[22] Filed: Nov. 6, 1998

[30] Foreign Application Priority Data

Nov. 7, 1997 [JP] Japan ..... 9-306063
Nov. 19, 1997 [JP] Japan ..... 9-318308

[51] Int. Cl.[7] ..... H01F 21/00

[52] U.S. Cl. ..... 336/110; 335/306; 336/175; 336/83; 336/212

[58] Field of Search ..... 336/175, 176, 336/174, 200, 221, 233, 212, 110, 83; 335/284, 285, 306, 288

[56] References Cited

U.S. PATENT DOCUMENTS

| | | | |
|---|---|---|---|
| 3,721,189 | 3/1973 | Bray | 101/382 MV |
| 4,621,416 | 11/1986 | Krause et al. | 29/606 |
| 5,347,255 | 9/1994 | Saitoh et al. | 336/83 |
| 5,694,030 | 12/1997 | Sato et al. | 323/282 |

FOREIGN PATENT DOCUMENTS 2-172209 7/1990 Japan .

*Primary Examiner*—Michael L. Gellner
*Assistant Examiner*—Tuyēn T. Nguyēn
*Attorney, Agent, or Firm*—Keating & Bennett, LLP

[57] ABSTRACT

A soft magnetic core is substantially cylindrical and a linear-shaped coil conductor is inserted through a hole in the central portion of the soft magnetic core. A hard magnetic material sheet has areas which are magnetized in a thickness direction thereof and the areas are arranged in strips so that a magnetization direction of adjacent strips is mutually opposite. The hard magnetic material is wound on the outside surface of the soft magnetic core and is fixed to the soft magnetic core. The direction of the areas formed as strips of the hard magnetic material is substantially perpendicular to the axial direction of the coil conductor.

17 Claims, 9 Drawing Sheets

HIGH-FREQUENCY CHOKE COIL

BACKGROUND OF THE INVENTION

1. Field of the Invention

The present invention relates to a high-frequency choke coil, and more particularly, to a high-frequency choke coil used for removing high-frequency noise radiated from and entering electronic equipment and similar devices.

2. Description of the Related Art

Up to now, in order to improve the high-frequency characteristic of a high-frequency choke coil, a method for suppressing stray capacitance of the coil conductor and for making the frequency characteristic of the magnetic core better by improving the quality of the magnetic core material at the same time has been used. Alternatively, a method for obtaining a high impedance by increasing the number of turns of the coil conductor and for compensating for the low relative magnetic permeability has been used.

However, even if the quality of the magnetic core material is improved, there is a problem that the relative magnetic permeability is decreased and a high impedance can not be obtained in a high-frequency range because the frequency characteristic of ferrite as a magnetic core material exhibits a phenomenon called "Snoek limit."

Also, when the decreased relative magnetic permeability in a high-frequency range is compensated by increasing the number of turns of a coil conductor, the stray capacitance is increased to generate an LC resonance. That is, if this method is relied on, the impedance is made high at a resonance frequency, but the Q factor also becomes high. Consequently, the insertion loss of the high-frequency choke coil is decreased. Moreover, because the resonance frequency is varied because of inductance and capacitance components distributed around the high-frequency choke coil, it has been inappropriate to apply this method to a choke coil.

SUMMARY OF THE INVENTION

To overcome the problems described above, preferred embodiments of the present invention provide a high-frequency choke coil which achieves a high impedance and a low Q factor and large insertion loss of the coil even in a high-frequency range in a GHz band, while preventing the frequency characteristic from being affected by surrounding circuit elements.

In order to overcome the problems described above, a high-frequency choke coil of preferred embodiments of the present invention has an impedance that is made high in a high-frequency range by applying a magnetic field in a direction that is substantially perpendicular to a magnetic field produced by an electric current flowing through the coil conductor inside a soft magnetic core and as a result, by causing a ferrimagnetic resonance inside the soft magnetic core.

Also, a high-frequency choke coil according to preferred embodiments of the present invention is characterized in that a hard magnetic material having at least a pair of areas in which the magnetization direction is opposite to each other is arranged around a soft magnetic core so that the magnetization direction is nearly perpendicular to the surface of the soft magnetic core.

Further, a high-frequency choke coil according to preferred embodiments of the present invention is characterized in that a hard magnetic material magnetized in a direction that is nearly perpendicular to the surface of a soft magnetic core is arranged around the soft magnetic core, and in that a magnetic field produced by the electric current flowing through a coil conductor is nearly perpendicular to the magnetic field produced by the hard magnetic material inside the soft magnetic core.

In accordance with the above-described construction, inside a soft magnetic core, a magnetic field is applied in a direction that is substantially perpendicular to the magnetic field caused by a high-frequency noise current flowing through a coil conductor. As a result of this arrangement, a ferrimagnetic resonance is created in the soft magnetic core and the peak of the imaginary part ($\mu''$) of the complex permeability is shifted towards a higher frequency side compared with the case of a natural resonance. As a result, a choke coil having a low Q-factor and a large insertion loss; is achieved even in a GHz band.

Also, because a hard magnetic material having at least a pair of areas in which the magnetization direction of which is opposite to each other is arranged around the soft magnetic core and the magnetization direction is nearly perpendicular to the surface of the soft magnetic core, the magnetic flux originating from the hard magnetic material passes through a closed magnetic circuit formed by the soft magnetic core, and the permeance is significantly increased to a very high value. Accordingly, a reaction magnetic field acting on the hard magnetic material is significantly decreased and the magnetic stability of the high-frequency choke coil is improved.

These and other elements, features, and advantages of the present invention will be apparent from the following detailed description of preferred embodiments of the present invention, as illustrated in the accompanying drawings.

DETAILED DESCRIPTION OF PREFERRED EMBODIMENTS

Hereinafter, a high-frequency choke coil according to preferred embodiments of the present invention is explained based on the attached drawings.

Figure 1:
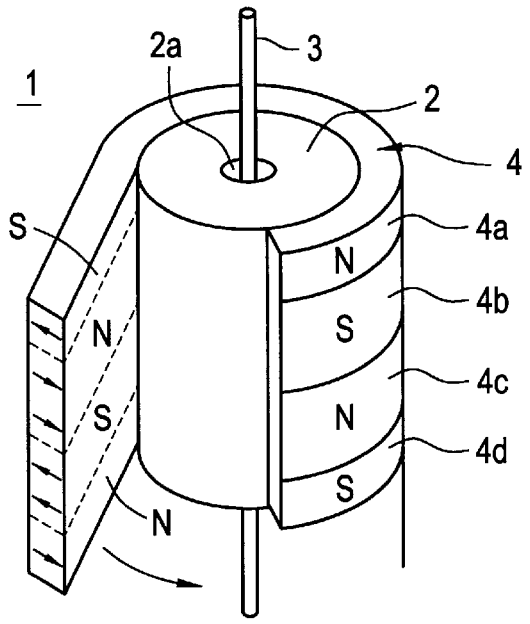
FIG. 1 is a perspective assembled view showing a first preferred embodiment of a high-frequency choke coil relating to the present invention.

As shown in FIG. 1, a high-frequency choke coil 1 is preferably composed of a soft magnetic core 2, a coil conductor 3, and a hard magnetic material 4. Here, the expression "soft" means that a coercive force is small and the expression "hard" means that a coercive force is large. The soft magnetic core 2 is preferably substantially cylindrical and the linear-shaped coil conductor 3 is inserted through a through-hole provided in the central portion of the soft magnetic core 2. As the material for the soft magnetic core 2, spinel ferrites and others may be used. Silver, copper, and other suitable materials may be used for the material of the coil conductor 3.

The hard magnetic material 4 is formed as a sheet, and has areas 4*a*, 4*b*, 4*c*, and 4*d* which are magnetized in a thickness direction thereof. The areas 4*a*, 4*b*, 4*c*, and 4*d* are arranged as strips so that magnetization directions of adjacent strips are mutually opposite. When the areas 4*a*–4*d* are magnetized, it is desirable for them to produce more than 28 kA/m so that the choke coil 1 maintains a high impedance in a high-frequency range of 1 GHz or more because the frequency of the ferrimagnetic resonance of the soft magnetic core 2 is proportional to the strength of the magnetic field.

The hard magnetic material 4 is wound on the outside surface of the soft magnetic core 2 and is fixed to the soft magnetic core 2 via adhesive, screws, or other suitable materials or elements. The direction of the areas 4*a*–4*d* of the hard magnetic material 4, that is, the direction of the extension of strips (the circumferential direction of the soft magnetic core 2) is preferably substantially perpendicular to the axial direction of the coil conductor 3. For the material of the hard magnetic material 4, for example, a material such as hard magnetic ferrite powder mixed into silicone rubber, etc. or nylon resin, etc. and kneaded, is preferably used. Further, in order to set a hard magnetic material 4 onto a soft magnetic core 2, besides a method for winding a flexible and sheet-like element on the outside surface of the soft magnetic core 2, for example, a method in which a part of a cylindrical shape is formed by injection molding using the rubber or resin mixed with hard magnetic powder and kneaded and then inserting a soft magnetic core 2 into the hole of the cylindrical hard magnetic material may be used.

Next, the operation and advantages functioning of a high-frequency choke coil 1 constructed as described above are explained.

Figure 2:
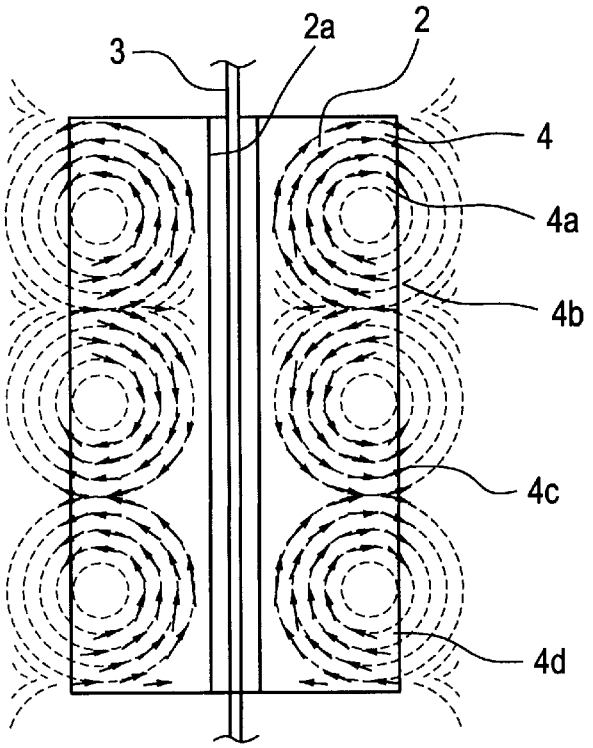
FIG. 2 is a vector diagram of the magnetic field of the high-frequency choke coil shown in FIG. 1.

When a high-frequency noise current flows through the coil conductor 3, a magnetic field passing around in a plane which is substantially perpendicular to the axial direction of the coil conductor 3 is produced around the coil conductor. On the other hand, as for the hard magnetic material 4, because the magnetization direction of the areas 4*a*–4*d* is substantially perpendicular to the outside surface of the soft magnetic core 2, the magnetic field of the hard magnetic material 4 passes around in a plane which is substantially parallel to the axial direction of the coil conductor 3 as shown in FIG. 2.

Figure 3A:
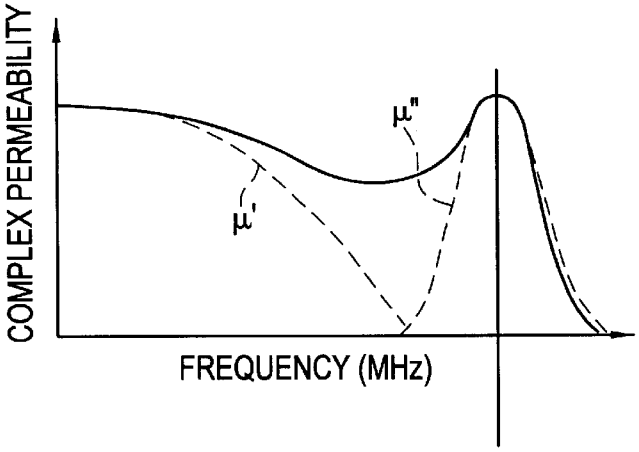
FIGS. 3A and 3B are explanatory diagrams for the ferrimagnetic resonance.
Figure 3B:
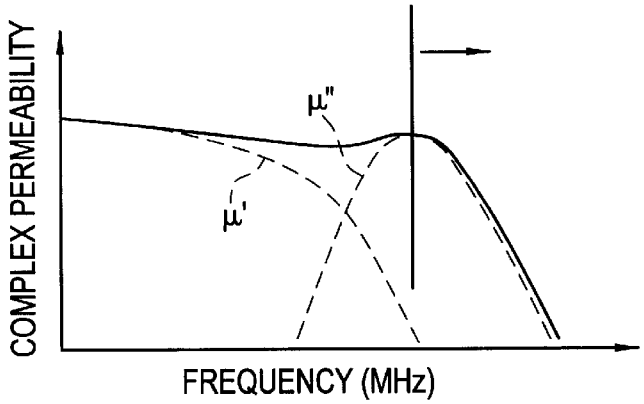

Therefore, the magnetic field produced by the hard magnetic material 4 becomes substantially perpendicular to the magnetic field produced by the high-frequency noise current in the soft magnetic core 2. This fact causes a ferrimagnetic resonance in the soft magnetic core 2 and the peak of the imaginary part ($\mu''$) of the complex permeability of the soft magnetic core 2 is shifted into a GHz band as shown in FIG. 3A. In contrast, in the case of a conventional choke coil not having any hard magnetic material, natural resonances are caused in the soft magnetic core. Accordingly, the peak of the imaginary part ($\mu''$) of the complex permeability of the soft magnetic core is within a MHz band as shown in FIG. 3B.

As a result of the structure described above, the choke coil 1 according to preferred embodiments of the present invention has the peak of the imaginary part ($\mu''$) of the complex permeability shifted towards a higher frequency side compared with a conventional choke coil, and can have a low Q-factor and large insertion loss even in a GHz band.

Figure 4:
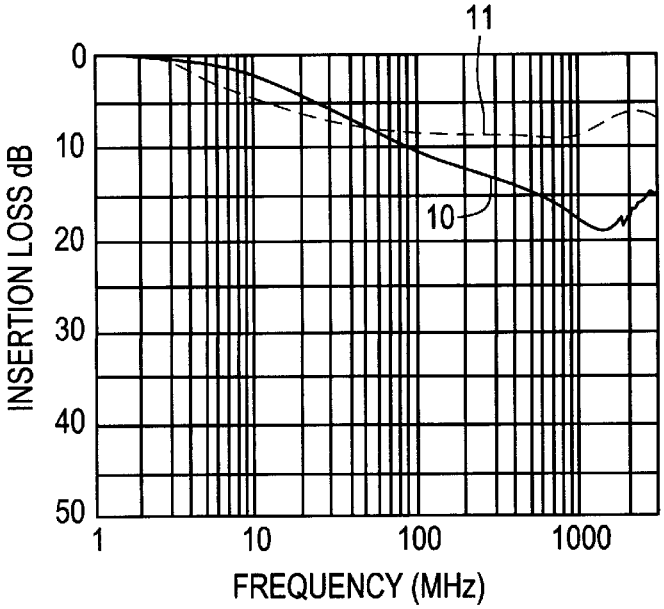
FIG. 4 is a graph showing the characteristic of the insertion loss of the high-frequency choke coil shown in FIG. 1.

In FIG. 4, the characteristic of the insertion loss of a choke coil according to a first preferred embodiment is shown. (See solid line 10.) For comparison, the characteristic of the insertion loss of a conventional choke coil not having any hard magnetic material is also shown via the dofted line in FIG. 4. A comparison of the graphs in FIG. 4 illustrate that the choke coil according to the first preferred embodiment has a larger insertion loss than the conventional choke coil.

Further, because the hard magnetic material 4 has surrounding areas 4*a* and 4*b*, 4*b* and 4*c*, 4*c* and 4*d*, the magnetization direction of each of which is opposite to each other, the magnetic flux produced by the hard magnetic material 4 passes through a closed magnetic circuit formed by the soft magnetic core 2. Accordingly, the permeance is significantly increased and the reaction magnetic field acting on the hard magnetic material 4 is significantly decreased. As a result, the magnetic stability of the choke coil 1 is improved. Furthermore, the magnetic flux leaking outside the choke coil 1 is greatly reduced. Also, the magnetic field produced by the hard magnetic material 4 is much stronger around the boundary portions of the areas 4*a*–4*d* and this leads to the fact that the frequency of the ferrimagnetic resonance of the soft magnetic core 2 is position-dependent. Because of this, the characteristic of the insertion loss of the choke coil is made wideband.

Figure 5:
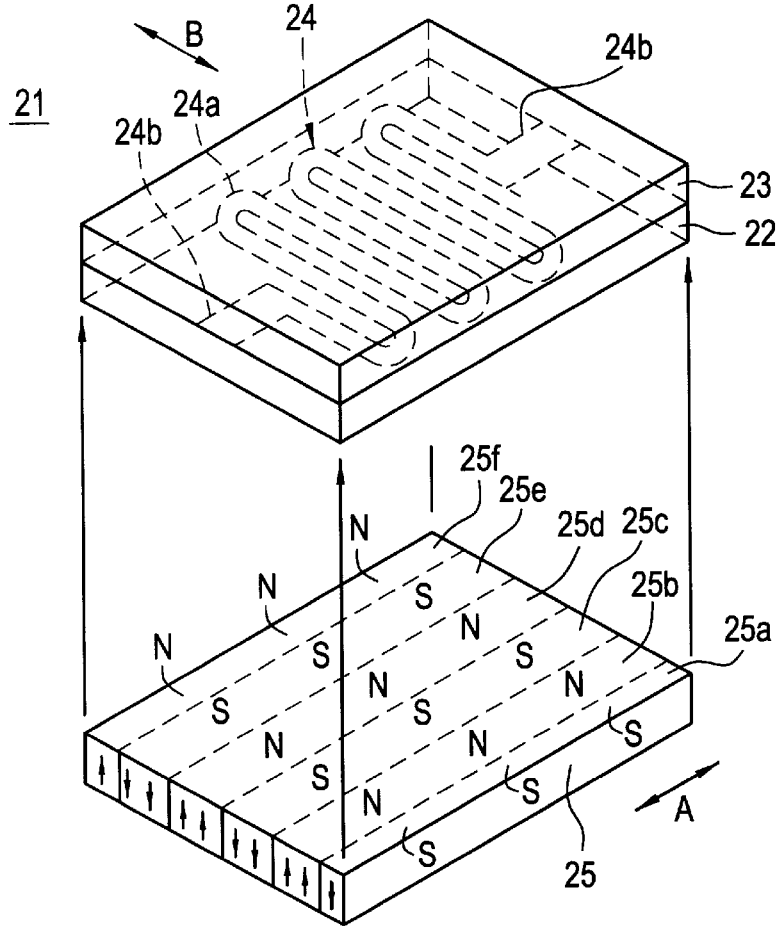
FIG. 5 is a perspective assembled view showing a second preferred embodiment of a high-frequency choke coil relating to the present invention.

As shown in FIG. 5, a second preferred embodiment provides a high-frequency choke coil 21 which includes soft magnetic substrates (cores) 22, 23, a coil conductor 24 arranged between the soft magnetic substances 22 and 23, and a hard magnetic substrate 25. The soft magnetic substrates 22, 23 having a substantially rectangular shape is made from spinel ferrites, etc. In FIG. 5, the hard magnetic substrate 25 is arranged separate from the soft magnetic substrates 22, 23, but actually the hard magnetic substrate 25 is arranged in contact with or in proximity to the soft magnetic substrate 22 and/or 23.

The coil conductor 24 is disposed on the soft magnetic substrate 22 using a method of printing, dry plating, photolithograph, etc. The coil conductor 24 includes a coil portion 24*a* arranged in a zigzag pattern and lead portions 24*b*, 24*b* provided at both end portions of the coil portion 24*a*. However, the coil portion 24*a* may be arranged in a straight line or other pattern. The lead portions 24*b*, 24*b* are respectively exposed at opposite sides of the soft magnetic substrate 22. On the upper surface of the soft magnetic substrate 22 having the coil conductor 24 disposed thereon, the soft magnetic substrate 23 is attached preferably using adhesive. These soft magnetic substrates 22 and 23 form a nearly closed magnetic circuit around the coil conductor 24.

The hard magnetic substrate 25 preferably has substantially the same shape as the soft magnetic substrates 22, 23, and is made up of hard ferrites, etc. The hard magnetic substrate 25 has areas 25*a*–25*f* which have been magnetized in a thickness direction thereof. Further, the areas 25*a*–25*f* are arranged in strips such that adjacent strips have opposite magnetization directions. This hard magnetic substrate 25 is arranged on the side of the lower surface of the soft magnetic substrate 22, and, for example, the substrates 22 and 25 are attached to each other using adhesive. The direction of the areas 25*a* through 25*f* of the hard magnetic substrate 25, that is, the direction of the strips (direction of arrow A in FIG. 5) is preferably substantially perpendicular to the direction of the straight line portion (direction of arrow B in FIG. 5) of the coil portion 24*a* in the coil conductor 24. Further, in the second preferred embodiment, when another hard magnetic substrate 25 is set on the side of the soft magnetic substrate 23, it is desirable that the areas having the same magnetization direction (for example, areas 25*a*, 25*a*, and so on) are disposed one on top of another.

Next, the operation and advantageous functioning of a high-frequency choke coil 21 constructed as described above are explained.

When a high-frequency noise current flows through the coil conductor 24, a magnetic field is produced around the coil conductor 24 (in a plane substantially perpendicular to the direction of arrow B). On the other hand, as for the hard magnetic material, because the magnetization direction of the areas 25*a*–25*f* is substantially perpendicular to the surface (main side) of the soft magnetic substrate 22, the magnetic field of the hard magnetic substrate 25 passes around in the plane substantially perpendicular to the direction of arrow A. Accordingly, the magnetic field produced by the hard magnetic substrate 25 becomes substantially perpendicular to the magnetic field produced by the high-frequency noise current flowing in the straight line portion of the coil portion 24*a* inside the soft magnetic substrates 22, 23. This fact causes a ferrimagnetic resonance in the soft magnetic substrates 22, 23 and a choke coil 21 having a low Q-factor and large insertion loss even in a GHz band is achieved.

Further, because the hard magnetic substrate 25 has the surrounding areas 25*a* and 25*b*, 25*b* and 25*c*, 25*e* and 25*f*, the magnetization direction of each of which is opposite to an adjacent strip, the magnetic flux produced by the hard magnetic substrate 25 passes through a closed magnetic circuit formed by the soft magnetic substrates 22, 23. Accordingly, the permeance is greatly increased and the reaction magnetic field acting on the hard magnetic substrate 25 is significantly decreased. As a result, the magnetic stability of the choke coil 21 is improved. Furthermore, the magnetic flux leaking outside of the choke coil 21 is greatly decreased. Also, the magnetization field produced by the hard magnetic substrate 25 is much stronger around the boundary portions of the areas 25*a* through 25*f* and this leads to the fact that the frequency of the ferrimagnetic resonance of the soft magnetic substrates 22, 23 is position-dependent. Because of this, the characteristic of the insertion loss of the choke coil 21 is made wideband.

Figure 6:
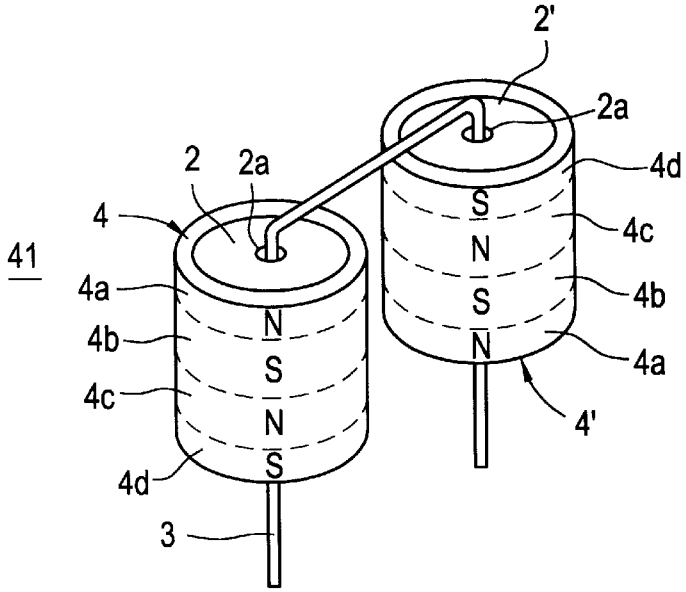
FIG. 6 is a perspective view showing a third preferred embodiment of a high-frequency choke coil relating to the present invention.

Another preferred embodiment of a high-frequency choke coil 41 shown in FIG. 6 is similar to a soft magnetic core 2' with a hard magnetic material 4' wound which is additionally assembled into a high-frequency choke coil 1 according to the first preferred embodiment. The two hard magnetic materials 4, 4' are set to have the same directional arrangement along the axis of the coil conductor 3. The high-frequency choke coil 41 having the above construction achieves the same advantageous functions as the high-frequency choke coil according to the first preferred embodiment and the advantageous effects are even more enhanced.

Figure 7:
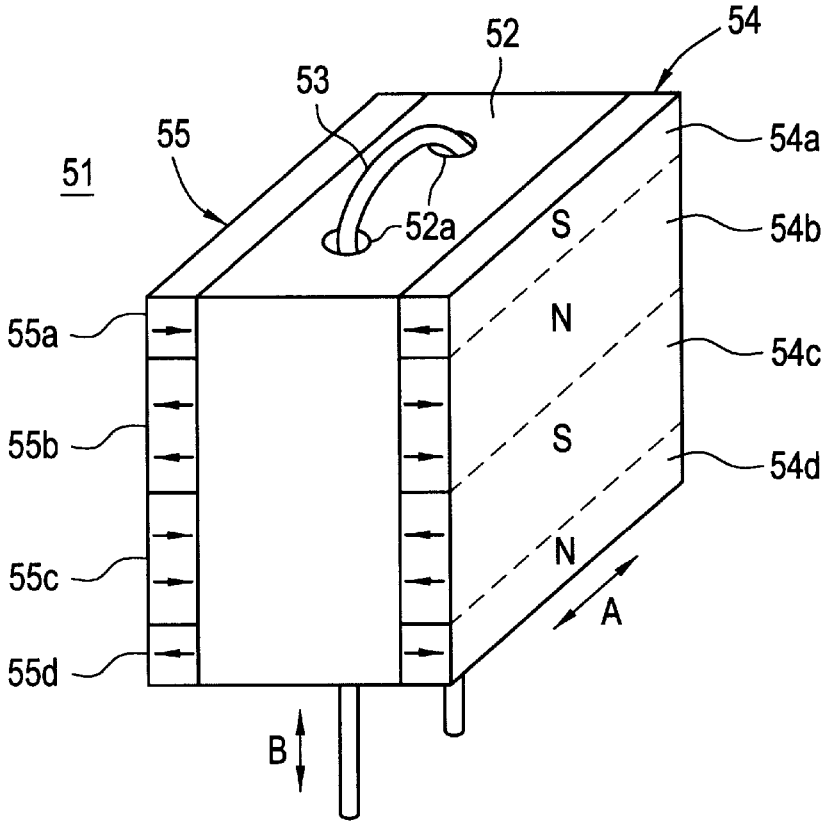
FIG. 7 is a perspective view showing a fourth preferred embodiment of a high-frequency choke coil relating to the present invention.

As shown in FIG. 7, a high-frequency choke coil 51 includes a soft magnetic core 52, a coil conductor 53, and hard magnetic substrates 54, 55. The soft magnetic core 52 is substantially square and has two through-holes 52*a* and 52*a*. The substantially U-shaped coil conductor 53 has two leg portions which pass through the through-holes 52*a* and 52*a*, respectively.

The hard magnetic substrates 54 and 55 have areas 54*a*–54*d*, and 55*a*–55*d*, which are magnetized in a respective thickness direction thereof. Further, the areas 54*a*–54*d*, and 55*a*–55*d* are arranged in strips such that adjacent strips have opposite magnetization directions. In order that the magnetic field of each of the hard magnetic substrates 54, 55 is made to equivalently cross the magnetic field produced a round the coil conductor 53 produced by a high-frequency noise current, the hard magnetic substrates 54, 55 are bilaterally arranged on both sides of the soft magnetic core 52 so that the areas having the magnetization direction opposite to each other (for example, areas 54*a* and 55*a*, etc.) are opposed to face the coil conductor 53, and, for example, they are attached together using adhesive. At this time, the direction of extension of the areas 54*a*–54*d*, 55*a*–55*d* in strips in the hard magnetic substrates 54, 55 (direction of arrow A in FIG. 7) is set to be substantially perpendicular to the direction of the leg portions of the coil conductor 53 (direction of arrow B in FIG. 7).

The high-frequency choke coil 51 having the above construction achieves the same advantageous operation and functions as the high-frequency choke coil 41 according to the third preferred embodiment.

Figure 8:
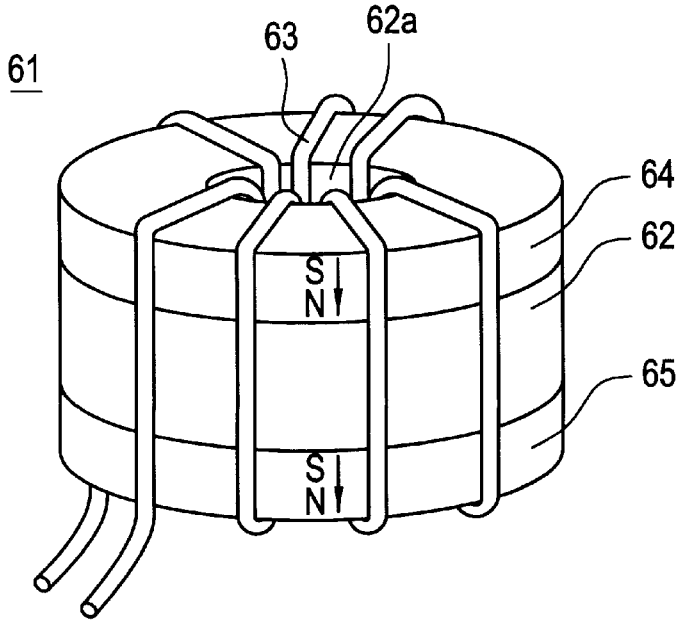
FIG. 8 is a perspective view showing a fifth preferred embodiment of a high-frequency choke coil relating to the present invention.

According to another preferred embodiment as shown in FIG. 8, a high-frequency choke coil 61 includes a soft magnetic core 62, a coil-wire 63, and hard magnetic materials 64, 65. The soft magnetic core 62 has a substantially doughnut-shape and is made up of spinel ferrite or other suitable material.

The hard magnetic materials 64, 65 are ring-shaped and made up of hard ferrite, or other suitable material. The hard magnetic materials 64, 65 are magnetized in a thickness direction, respectively. These hard magnetic materials 64, 65 are arranged so that their magnetization direction is made uniform on the upper and lower surfaces of the soft magnetic core 62 so as to sandwich the soft magnetic core 62, and, for example, they are attached together using adhesive. This causes the hard magnetic materials 64, 65 to apply a magnetic field that is substantially parallel to the central axis of the hole 62*a* in the soft magnetic core 62. The coil-wire 63 is wound on the soft magnetic core 62*b* attached with the hard magnetic materials 64, 65 using adhesive so as to pass through the hole 62*a* in a toroidal way.

Also, in the fifth preferred embodiment, in order to strengthen the magnetic field by the hard magnetic material, the hard magnetic materials 64, 65 are arranged on both of the upper and lower surfaces of the soft magnetic core 62, but this is not necessarily limited and other arrangements are possible. In accordance with the strength of the magnetic field required, either of the two hard magnetic materials 64, 65 may be omitted.

In the high-frequency choke coil 61 having the above construction, when a high-frequency noise current flows through the coil-wire 63, a magnetic field is produced around the coil-wire 63. The magnetic field is substantially perpendicular to the magnetic field produced by the hard magnetic materials 64, 65 inside the soft magnetic core 62. This causes a ferrimagnetic resonance in the soft magnetic core 62 and the choke coil 61 having a low Q-factor and a large insertion loss even in a GHz band is achieved.

Further, the high-frequency choke coil according to preferred embodiments of the present invention is not limited to the above-described embodiments and various modifications are possible within the scope of the invention.

For example, the high-frequency choke coil according to the above-mentioned second preferred embodiment, if circumstances require, may be arranged so that the coil conductor 24 is exposed without the soft magnetic substrate 23. Also, the substrates 22, 23, and 25 are described as being composed of previously sintered substrates put together using adhesive, but this is not necessarily limiting. The high-frequency choke coil 21 may be constructed in such a way that after a green sheet layer on the surface of which a coil conductor 24 is formed via printing or other suitable methods, and green sheet layers 23 and 25 have been laminated, they are integrally fired.

Further, the choke coil 21 may be produced by a method described below. After a hard magnetic layer has been formed using hard magnetic material contained in a paste by a method of printing, etc., a soft magnetic layer is formed on the surface of the hard magnetic layer using soft magnetic material in a paste. Next, a conductive material contained in a paste is printed on the surface of the soft magnetic layer to form a coil conductor of any form or pattern. In such a way, by successively forming layer one on top of another, a multi-layered choke coil is provided.

Further, a high-frequency choke coil may be of an array type with a plurality of choke coils internally stored. Furthermore, if the hard magnetic material according to the first, second, third, and fourth preferred embodiments has at least one pair of areas (two or more) arranged in strips, that is enough. When the characteristic of the insertion loss being made wideband and the easiness of the manufacture of the high-frequency choke coil are considered, it is desirable to used a hard magnetic material having about five areas arranged in strips.

Further, preferred embodiments of a core holder relating to the present invention are explained based on the attached drawings.

Figure 9:
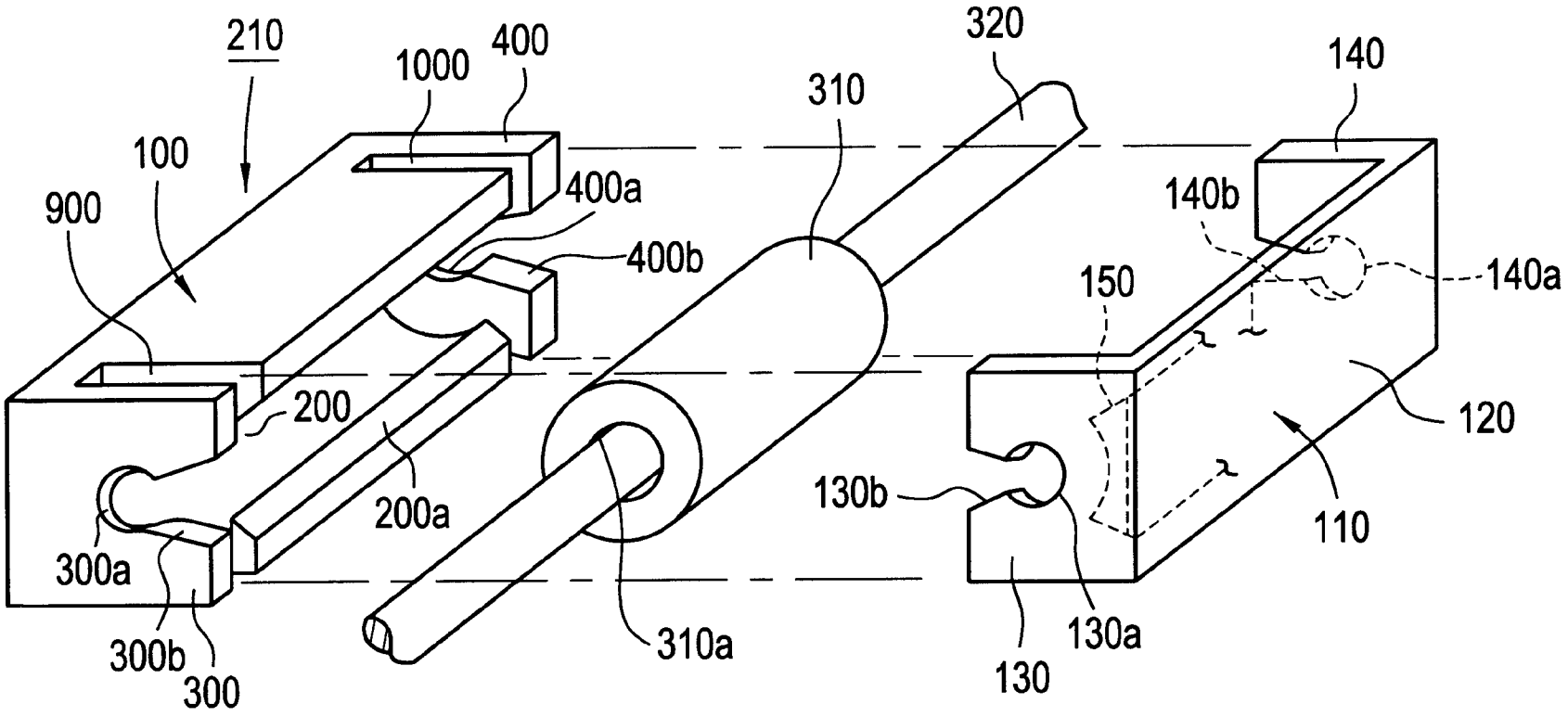
FIG. 9 is a perspective view showing a preferred embodiment of a core holder relating to the present invention.

As shown in FIG. 9, a core holder 210 includes a main body 100 having a concave core housing portion 200 and supports 300, 400 provided on both sides of the core housing portion 200, and a cover 110 to close an opening 200*a* of the core housing portion 200.

The core housing portion 200 of the main body 100 preferably has a wall surface having a shape that is substantially similar to the outside surface of a ring-shaped magnetic core 310 which is described later, so that the gap between the inner wall surface of the core housing portion 200 and the outside surface of the ring-shaped magnetic core 310 is small and so that the ring-shaped magnetic core 310 is supported in the core housing portion 200 in a stable manner. Preferably, the outside surface of the ring-shaped magnetic core 310 is as large as the inner wall surface of the core housing portion 200 disposed in contact with and pressing against the magnetic core 310. Therefore, the inner wall surface of the core housing portion 200 of the main body 100 is substantially circular in cross-section so as to correspond to the substantially circular shape of the ring-shaped magnetic core 310, and the dimension of the inner diameter of the core housing portion 200 is set to be slightly smaller than the outside dimension of the ring-shaped magnetic core 310.

Figure 11:
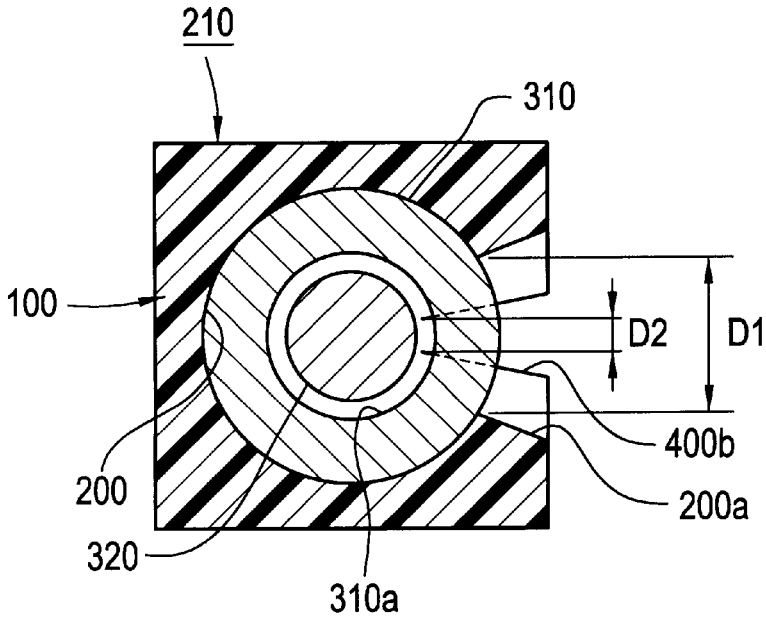
FIG. 11 is a cross-sectional view taken along line III—III of FIG. 10.

The gap D1 of the opening portion 200*a* of the core housing portion 200 (See FIG. 11) is a little smaller than the dimension of the inner diameter of the core housing portion 200, and accordingly, the ring-shaped magnetic core 310 received in the core housing portion 200 is prevented from being removed from the core holder 210. Further, the opening 200*a* is made narrower as it extends deeper so that the ring-shaped magnetic core 310 is easily inserted into the core housing portion 200.

However, in the case of the core holder 210 according to the present preferred embodiment, when the gap D1 of the opening portion 200*a* of the core housing portion 200 is a little smaller than the dimension of the outside diameter of the ring-shaped magnetic core 310, it is not necessary that the dimension of the inside diameter of the core housing portion 200 is smaller than the outside diameter of the ring-shaped magnetic core 310 and the dimension of the inner diameter of the core housing portion 200 can be larger than the dimension of the outside diameter of the ring-shaped magnetic core 310. The reason is that because the supports 300, 400, are provided on both sides of the core housing portion 200, once the ring-shaped magnetic core 310 has been received in the core housing portion 200, it is difficult to move the ring-shaped magnetic core 310 out of position even if the ring-shaped magnetic core 310 is not fixed by the inside wall surface of the core housing portion 200 in contact with and pressing against the outside surface of the ring-shaped magnetic core 310.

In the support portions 300,400 of the main body 100, holes 300*a*, 400*a* for accommodating a cable are provided at a central portion, and further notches 300*b*, 400*b* extending in the same direction as the side in which the opening portion 200*a* of the core housing portion 200 is located, are provided next to the holes 300*a*, 400*a*. Regarding the holes 300*a*, 400*a*, it is desirable that the inner wall surface thereof has a shape corresponding to the shape of the outside surface of a cable 320 to be described later. This allows that the gap between the inner wall surface of the holes 300*a*, 400*a* and the outside surface of the cable 320 to be very small and accordingly, the inner wall surface of the holes 300*a*, 400*a* are disposed in reliable and stable contact with and press against the outside surface of the cable 320. Therefore, the holes 300*a*, 400*a* are substantially circular in accordance with the substantially circular section of the cable 320, and the dimension of the inner diameter of the holes for cable 300*a*, 400*a* is smaller than the outside diameter of the cable.

Also, the gap D2 of the notches 300*b*, 400*b* (See FIG. 11) is slightly smaller than the dimension of the inner diameter of the holes 300*a*, 400*a*, and accordingly, the cable 320 inserted into the holes 300*a*, 400*a* is difficult to move out of position. Further, the notches 300*b*, 400*b* are narrower as they extend closer to the holes 300*a*, 400*a* so that the cable 320 is easily inserted into the holes 300*a*, 400*a*. Between the core housing portion 200 and the support portions 300, 400, slits 900, 1000 are formed to join the cover 110 thereto.

The cover 110 preferably contains a body portion 120 having a flat board shape, support portions 130,140 provided at both end portions of the body portion 120, and a protrusion portion 150 provided inside the body portion 120. Holes 130*a*, 140*a* for accommodating the cable 320 are provided in a central portion of the support portions 130,140, respectively. Next to the holes 130*a*, 140*a*, notches 130*b*, 140*b* are provided. The holes 130*a*, 140*a* are substantially circular and the dimension of their inner diameter is slightly smaller than the outside diameter of the cable 320 for the reasons described above. Also, the shape of the notches 130*b*, 140*b* and the shape of the notches 300*b*, 400*b* in the support portions 300, 400 in the main body 100 are nearly symmetrical in relation to the cable 320. The protrusion portion 150 is substantially trapezoidal in its cross-section to match the shape of the opening portion 200*a* of the core housing portion 200 in the main body 100 and its upper surface is concave so as to reduce the gap between the outside surface of the ring-shaped magnetic core 310. (See FIG. 13).

Next, the function and operation of the core holder 210 having the above construction is explained together with the procedure for attaching the ring-shaped magnetic core 310 to the cable 320 using the core holder 210. As the material for the ring-shaped magnetic core 310, a soft magnetic material such as Ni—Zn, Mn—Zn, Mg—Zn ferrites, or other suitable material may be used. The cable 320 includes a conductor and a cladding material to cover the conductor. As a conductor, for example, a copper wire, a soldered copper wire, or other suitable materials may be used. As a cladding material, for example, vinyl chloride resin, urethane resin, or other suitable materials are used. In this preferred embodiment, the inner diameter of the ring-shaped magnetic core 310, that is, the diameter of the hole 310*a* is larger than the outside diameter of the cable 320.

Figure 10:
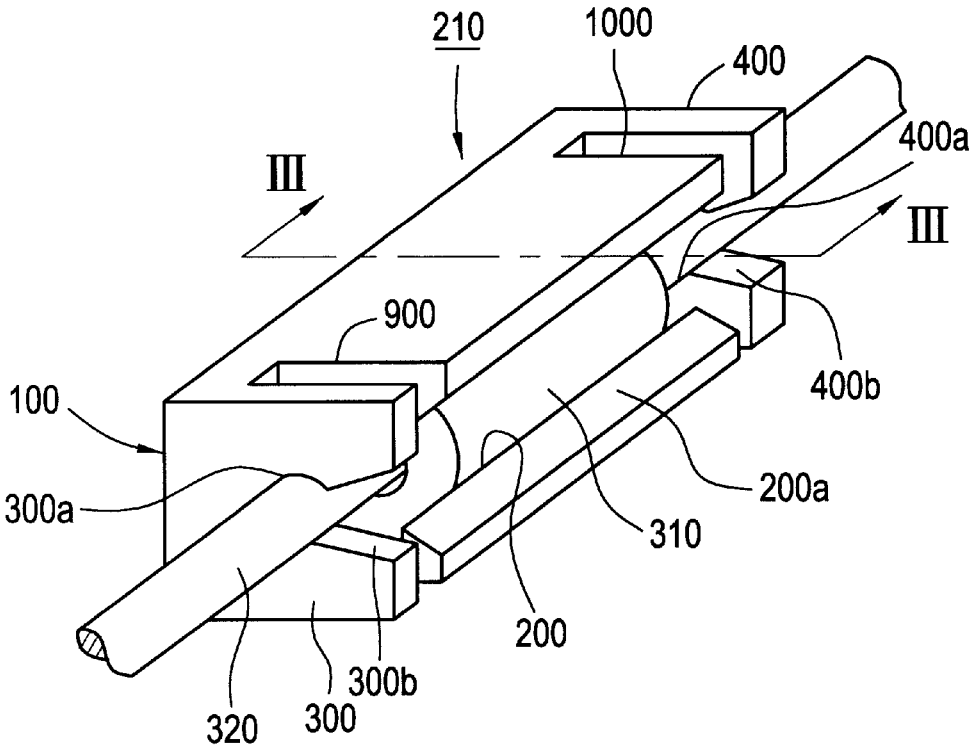
FIG. 10 is a perspective view showing the state in which a ring-shaped magnetic core is inserted into the core holder shown in FIG. 9.

After the cable 320 has been passed through the hole 310*a* of the ring-shaped magnetic core 310, as shown in FIG. 10, the ring-shaped magnetic core 310 is inserted into the core housing portion 200 through the opening portion 200*a* of the core housing portion 200 in the main body 100. That is, when the ring-shaped magnetic core 310 is inserted into the opening portion 200*a*, the opening 200*a* is widened because the opening portion 200*a* is elastic. When the ring-shaped magnetic core 310 is received in the core housing portion 200, the gap of the opening 200*a* returns to its previous narrower configuration, and the ring-shaped magnetic core 310 is prevented from being removed from the core housing portion 200. When the inner diameter of the core housing portion 200 is slightly smaller than the outside dimension of the ring-shaped magnetic core, because of the elasticity of the core housing portion 200, the outside surface of the ring-shaped magnetic core 310 is in contact with and pressing against the inner wall surface of the core housing portion 200 and accordingly, the ring-shaped magnetic core 310 is stably fixed in the core housing portion 200.

Further, nearly at the same time when the ring-shaped magnetic core 310 is received in the core housing portion 200, the cable 320 in the vicinity of the both end portions of the ring-shaped magnetic core 310 is inserted into the holes 300*a*, 400*a* through the notches 300*b*, 400*b* of the support portions 300, 400, respectively. That is, when the cable 320 is inserted into the notches 300*b*, 400*b*, the notches 300*b*, 400*b* are widened because of the elasticity of the notches 300 and 400. Once the cable 320 is inserted into the holes 300*a*, 400*a*, the gap of the notches 300*a*, 400*a* returns to its original narrower configuration, and the cable 320 is prevented from being removed from the holes 300*a*, 400*a*.

Because the dimension of the inner diameter of the holes 300*a*, 400*a* is slightly smaller than the outside diameter of the cable 320, the outside surface of the cable 320 elastically contacts and presses against the inner wall surface of the holes 300*a*, 400*a* by making use of the elasticity of the holes 300*a*, 400*a* or of the cladding material of the cable 320, and the core holder 210 is firmly fixed to the ring-shaped magnetic core 310 and to the cable 320 together.

Figure 12:
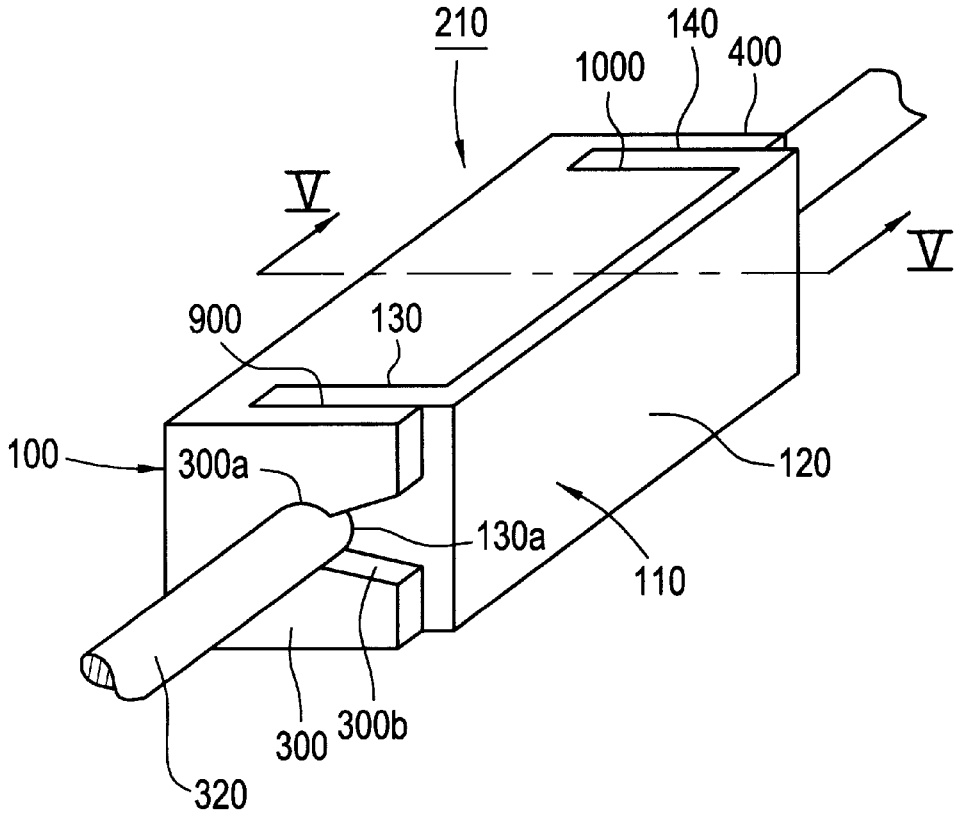
FIG. 12 is a perspective view showing the state in which a cover is attached to the core holder shown in FIG. 10.
Figure 13:
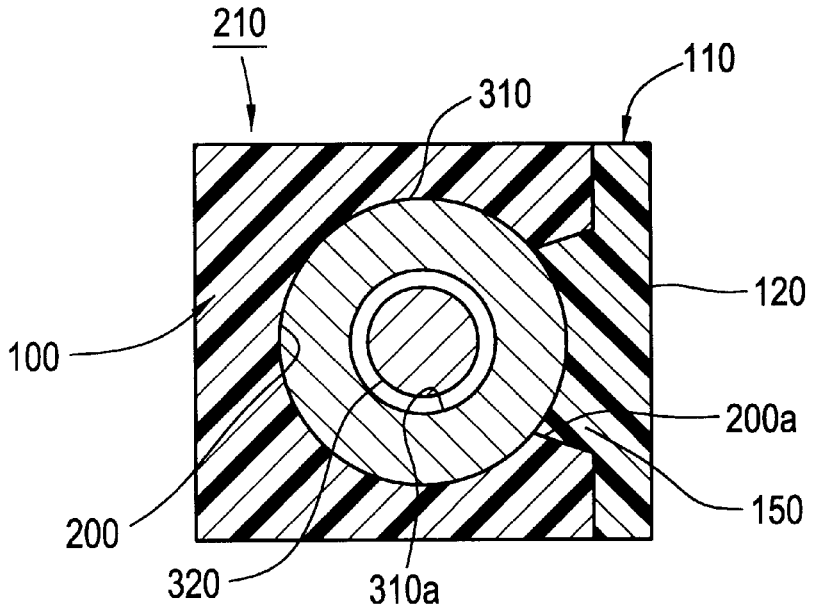
FIG. 13 is a cross-sectional view taken along line V—V of FIG. 12.

Next, as shown in FIGS. 12 and 13, the opening portion 200*a* of the core housing portion 200 in the main body 100 is closed by the cover 110. That is, at the same time when the support portions 130, 140 of the cover 110 are joined to the slits 900, 1000 in the main body 100, the portion of the cable 320 situated between both end portions of the ring-shaped magnetic core 310 and the holes 300*a*, 400*a* of the support portions 300, 400 in the main body 100 is inserted into the holes 130*a*, 140*a* through the notches 130*b*, 140*b* of the support portions 130, 140 in the cover 110, respectively. When the cable 320 is inserted into the notches 130*b*, 140*b*, the notches 130*b*, 140*b* are widened because of elasticity of the material used to form the cover 110. Then, once the cable 320 has been inserted into the holes 130*a*, 140*a*, the gap of the notches 130*b*, 140*b* returns to the previous narrower configuration and the cable 320 is prevented from being removed from the holes for cable 130*b*, 140*b*.

Because the dimension of the inner diameter of the holes 130*a*, 140*a* is slightly smaller than the outside diameter of the cable 320, the outside surface of the cable 320 elastically contacts and presses against the inner wall surface of the holes and accordingly, the cover 110 is firmly fixed to the cable 320. The protrusion portion 150 of the cover 110 is inserted into the opening portion 200*a* of the core housing portion 200, and the upper surface of the protrusion portion 150 is close to or in contact with the outside surface of the ring-shaped magnetic core 310. Thus, the cover 110 protects the ring-shaped magnetic core 310 against damage caused by external mechanical shock and against environmental moisture and erosive gasses, and as a result, the cover 110 is able to increase the reliability concerning the insulation of the ring-shaped magnetic core 310.

As explained above, the core holder 210*b* is able to fix the ring-shaped magnetic core 310 by simply inserting the ring-shaped magnetic core 310 into the core housing portion 200 through the opening portion 200*a*. Also, the core holder 210 is firmly fixed on the outside surface of the cable by simply inserting the cable 320 into the holes 300*a*, 400*a*, 130*a*, 140*a* through the notches 300*b*, 400*b*, 130*b*, 140*b*. Furthermore, if instead of the ring-shaped magnetic core 310 of an integral type, for example, a ring-shaped magnetic core made up of two split core pieces is used, the ring-shaped magnetic core can be fixed to the cable 320 in later operations.

Figure 14:
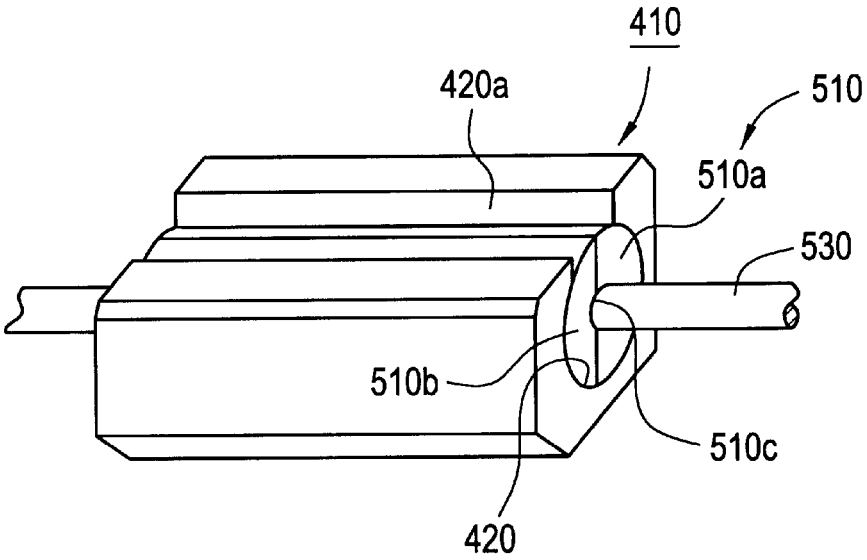
FIG. 14 is a perspective view showing another preferred embodiment of a core holder relating to the present invention.

As shown in FIG. 14, the core holder 410 has a core housing portion 420 having a substantially C-shaped cross-section. The shape of the inner wall surface of the core housing portion 420 substantially corresponds to the shape of the outer surface of the ring-shaped magnetic core 510. That is, the cross-sectional shape of the inner wall surface of the core housing portion 420 is substantially circular in accordance with the substantially circular shape cross section of the ring-shaped magnetic core 510, and the dimension of the inner diameter of the core housing portion 420 is slightly smaller than the outer diameter of the ring-shaped magnetic core 510. The gap of the opening portion 420*a* in the core housing portion 420 is made even slightly smaller than the dimension of the inner diameter of the core housing portion 420 and accordingly, the ring-shaped magnetic core 510 received in the core housing portion 420 is prevented from being removed from the core holder 410.

The function and advantageous operation of the core holder 410 having the above construction are explained together with the procedure for attaching the ring-shaped magnetic core 510 to the cable 530 using the core holder 210. The ring-shaped magnetic core 510 is preferably made up of two split core pieces 510*a* and 510*b*. The inner diameter of the ring-shaped magnetic core 510, that is, the diameter of the hole 510*c* is slightly smaller than the outside diameter of the cable 530. However, if the ring-shaped magnetic core 510 is not required to be positioned in a fixed state, the diameter of the hole 510*c*, may be larger than the outside diameter of the cable 530.

The ring-shaped magnetic core 510 with the cable 530 passed through the hole 510*c* is inserted into the core housing portion 420 through the opening 420*a* of the core housing portion 420. That is, when the ring-shaped magnetic core 510 is pushed into the opening portion 420*a*, because of the elasticity the core holder 410, the opening portion 420*a* is widened. Once the ring-shaped magnetic core 510 is received in the core housing portion 420, the gap of the opening 420*a* returns to its narrower previous configuration. Because the dimension of the inner diameter of the core housing portion 420 is slightly smaller than the outside dimension of the ring-shaped magnetic core 510, the outside surface of the ring-shaped magnetic core 510 elastically contacts and presses against the inner wall surface of the core housing portion 420 and accordingly, the ring-shaped magnetic core 510 is maintained in the core housing portion 420 in a stable manner.

Because the diameter of the hole 510*a* of the ring-shaped magnetic core 510 is slightly smaller than the outside dimension of the cable 530, the outside surface of the cable 530 elastically contacts and presses against the inner wall surface of the hole 510*c* by making use of the elasticity of the cladding material of the cable 530, and accordingly, the ring-shaped magnetic core 510 is firmly fixed to the cable and securely positioned.

In this way, the core holder according to this preferred embodiment, in spite of its simple construction, achieves nearly the same advantageous effects as the core holder 210*b* according to the preferred embodiment described earlier.

Figure 15:
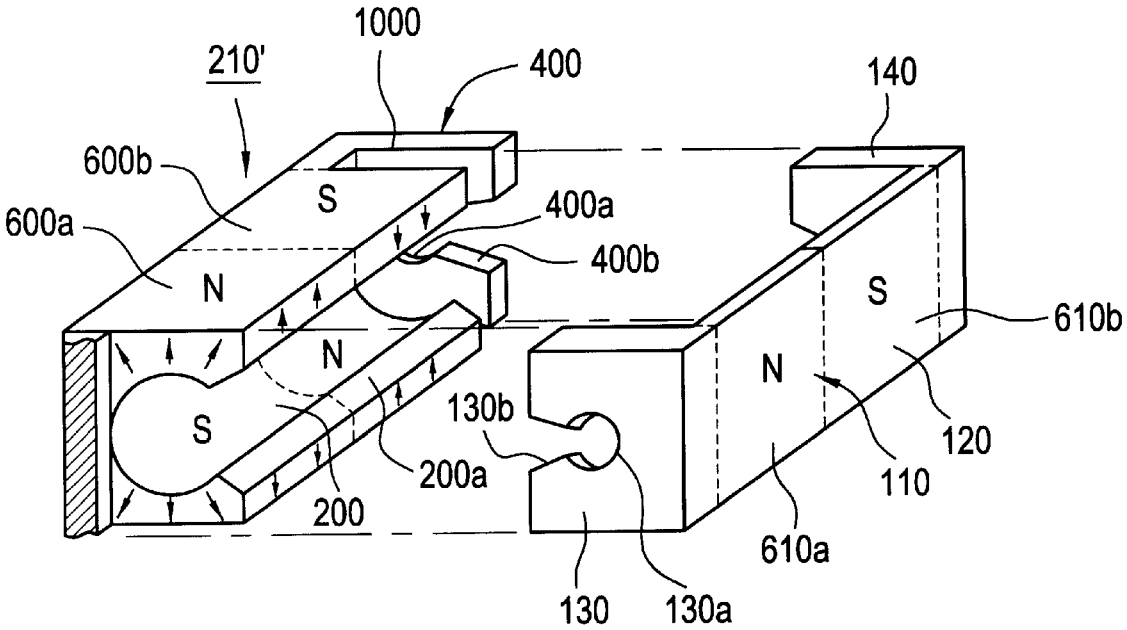
FIG. 15 is a perspective partial cutaway view showing a further preferred embodiment of a core holder relating to the present invention.
Figure 16:
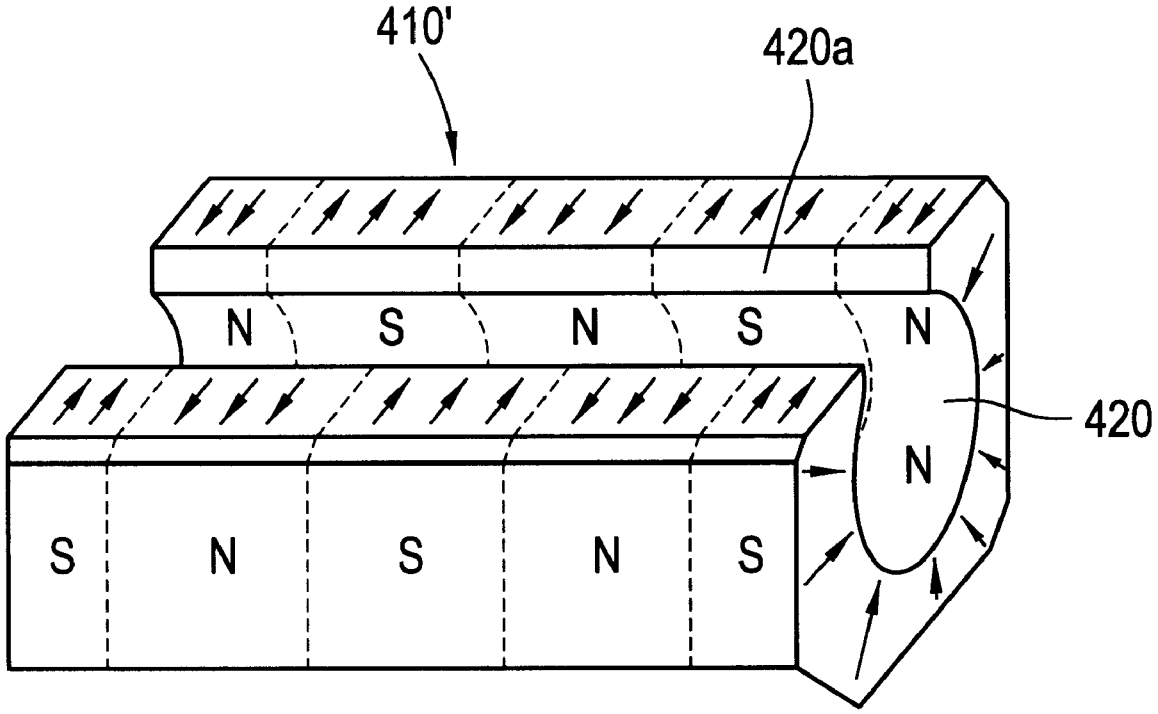
FIG. 16 is a perspective view showing another preferred embodiment of a core holder relating to the present invention.

As shown in FIGS. 15 and 16, as for the material of the core holders 210, 410 according to the above-mentioned two preferred embodiments, a hard magnetic material in which a hard magnetic powder added into resin and rubber is mixed and kneaded is used and the core holders 210, 410 which are made up of this hard magnetic material magnetized are used. The expression of "hard" means that a coercive force is large. For example, the main body 100 and cover material 110 of the core holder 210' made up of the hard magnetic material shown in FIG. 15 have areas 600*a*, 600*b*, 610*a*, 610*b* magnetized in a substantially radial direction relative to the axis of the cable 320, respectively. However, the support portions 300, 400, 130, 140 having surfaces which are substantially perpendicular to the axial direction of the cable 320 are not magnetized. The surrounding areas 600*a* and 600*b*, 610*a* and 610*b* are arranged so that their magnetization is alternately reversed. In the state that the ring-shaped magnetic core 310 which the cable 320 passes through is received inside the core holder 210, the magnetization direction of the areas 600*a*, 600*b*, 610*a*, 610*b* is nearly perpendicular relative to the outside surface of the ring-shaped magnetic core 310.

In the above construction, when a high-frequency noise current flows through the cable 320, a magnetic field passing around in a plane that is substantially perpendicular to the axial direction of the cable 320 is produced around the cable 320. On the other hand, because the magnetization direction of the areas 600*a* through 610*b* in the core holder 210' is substantially perpendicular relative to the outside surface of the ring-shaped magnetic core 310, the magnetic field in the core holder 210' passes around in a plane that is substantially parallel with the axial direction of the cable 320 inside the ring-shaped magnetic core 310. Therefore, the magnetic field of the core holder 210' meets at right angles with the magnetic field produced by the high-frequency noise current inside the ring-shaped magnetic core 310. Because of this, a ferrimagnetic resonance is caused in the ring-shaped magnetic core 310 and the peak of the imaginary part ($\mu''$) of the complex permeability of the ring-shaped magnetic core 310 is shifted towards the high-frequency side, and the insertion loss is significantly increased to a large value even in a GHz band. As a result, it is possible to improve a measure to counter EMI (electromagnetic interference) in a high-frequency band such as a GHz band, etc.

Further, because the ring-shaped magnetic core 310 is clad with the core holder 210' made up of a hard magnetic material, the magnetic field produced when a high-frequency current flows through the cable 320 is able to pass around not only the inside of the ring-shaped magnetic core 310, but also inside the core holder 2110', and accordingly, a higher impedance can be achieved.

Also, in the above-described preferred embodiments, a core housing portion having an inner wall surface which is substantially circular in cross-section has been explained by taking a ring-shaped magnetic core which is substantially circular in cross section, but the inner wall surface is not necessarily required to be substantially circular in cross section. For example, in the case of a substantially rectangular-in-cross-section ring-shaped magnetic core to be used for a flat cable and a flexible cable, the inner wall surface of the core housing portion is substantially rectangular in cross section corresponding to the magnetic core. Further, the cross section of a ring-shaped magnetic core is not necessarily required to have the same shape as the cross section of the inner wall surface of the core housing portion.

Furthermore, in the above-described preferred embodiments, the support portions 300, 400, are provided on both sides of the core housing portion 200, but either of them may be omitted. In addition, according to the specification of the core holder, the cover material may be omitted.

As made clear in the above explanation, according to the preferred embodiments of the present invention, because a ferrimagnetic resonance is produced in a soft magnetic core by a magnetic field which is substantially perpendicular to the magnetic field produced by a high-frequency noise current flowing through a coil inductor being applied, a high-frequency choke coil having a low Q-factor and a large insertion loss even in a GHz band is achieved. Further, because the frequency of the ferrimagnetic resonance of a soft magnetic core is proportional to the strength of a magnetic field applied, the characteristic of the insertion loss necessary for a choke coil can be controlled by changing the strength of the magnetic field.

Also, because a hard magnetic material having at least a pair of areas in which the magnetization direction is opposite to each other and the magnetization direction of which is substantially perpendicular to the surface of a soft magnetic core, is applied to the soft magnetic core, the magnetic flux produced by the hard magnetic material passes through a closed magnetic circuit formed by the soft magnetic core. Accordingly, the permeance is significantly increased and the reaction magnetic field acting on the hard magnetic material is greatly decreased, and as a result, the magnetic stability of the choke coil is improved. Furthermore, the magnetic flux leaking out of the choke coil is significantly reduced. Further, as the magnetic field of the hard material is strong around the boundary of the areas where the magnetization direction is opposite to each other, the frequency of the ferrimagnetic resonance of the soft magnetic core is position-dependent. Because of this, the characteristic of the insertion loss of the choke coil is made wideband which is desirable for eliminating high-frequency noise.

While the invention has been particularly shown and described with reference to preferred embodiments thereof, it will be understood by those skilled in the art that the foregoing and other changes in form and details may be made therein without department form the spirit and scope of the invention.

What is claimed is:

1. A high-frequency choke coil comprising:

a soft magnetic core having an opening extending therethrough;

a hard magnetic material having at least a pair of areas having mutually opposite magnetization directions and being disposed around said soft magnetic core such that said magnetization directions are nearly perpendicular to the surface of said soft magnetic core; and a coil conductor disposed inside of said soft magnetic core and extending through said opening in said soft magnetic core; wherein said soft magnetic core and sail coil conductor are arranged such that a magnetic field that is nearly perpendicular to a magnetic field produced by a current flowing through said coil conductor is produced inside said soft magnetic core and causes ferrimagnetic resonance to be produced inside said soft magnetic core so as to increase an impedance in a high-frequency range.

2. A high-frequency choke coil according to claim 1, wherein the soft magnetic core is substantially circular.

3. A high-frequency choke coil according to claim 1, wherein the soft magnetic core is substantially rectangular.

4. A high-frequency choke coil according to claim 1, wherein a hard magnetic material is disposed around said soft magnetic core.

5. A high frequency choke coil according to claim 4, wherein the hard magnetic material has a pair of areas having mutually opposite magnetization directions.

6. A high-frequency choke coil according to claim 5, wherein the pair of areas are strip-shaped members.

7. A high-frequency choke coil according to claim 1, wherein a peak of an imaginary part of complex permeability of is shifted toward a higher frequency side compared with a natural resonance.

8. A high-frequency choke-coil according to claim 1, wherein the soft magnetic core and the coil conductor are arranged to define a closed magnetic circuit at the soft magnetic core.

9. A high-frequency choke coil comprising:

a soft magnetic core having an opening extending therethrough;

a coil conductor disposed inside of said opening in said soft magnetic core;

a hard magnetic material having at least a pair of areas having mutually opposite magnetization directions and being disposed around said soft magnetic core such that said magnetization directions are nearly perpendicular to the surface of said soft magnetic core; and a hard magnetic material magnetized in a nearly perpendicular direction relative to a surface of said soft magnetic core and disposed around said soft magnetic core such that a magnetic field produced by a current flowing through said coil conductor and a magnetic field produced by said hard magnetic material intersect nearly at right angles with each other.

10. A high-frequency choke coil according to claim 9, wherein the soft magnetic core is substantially circular.

11. A high-frequency choke coil according to claim 9, wherein the soft magnetic core is substantially rectangular.

12. A high-frequency choke coil according to claim 9, wherein a hard magnetic material is disposed around said soft magnetic core.

13. A high frequency choke coil according to claim 12, wherein the hard magnetic material has a pair of areas having mutually opposite magnetization directions.

14. A high-frequency choke coil according to claim 13, wherein the pair of areas are strip-shaped members.

15. A high-frequency choke coil accord to claim 9, wherein a peak of an imaginary part of complex permeability of is shifted toward a higher frequency side compared with a natural resonance.

16. A high-frequency choke-coil according to claim 9, wherein the soft magnetic core and the coil indicator are arranged to define a closed magnetic circuit at the soft magnetic core.

17. A core holder comprising:

a ring-shaped soft magnetic core having a hole extending therethrough;

a hard magnetic material having at least a pair of areas having mutually opposite magnetization directions and being disposed around said soft magnetic core such that said magnetization directions are nearly perpendicular to the surface of said soft magnetic core;

a core housing portion having a concave shape to receive said ring-shaped soft magnetic core; and a coil conductor arranged to extend through the hole in the ring-shaped soft magnetic core;

wherein said core housing portion has an open portion with a gap that is slightly smaller than the outside diameter of said ring-shaped soft magnetic core and has elasticity in order to insert said ring-shaped soft magnetic core into said core housing portion, said core holder is made of a hard magnetic material magnetized in a direction nearly perpendicular to the surface of said ring-shaped soft magnetic core.

* * * * *